United States Patent [19]

Chun et al.

[11] Patent Number: 4,993,294

[45] Date of Patent: Feb. 19, 1991

[54] PUNCH HOLDER WITH A STRIPPER ARRANGEMENT

[75] Inventors: Victor L. Chun, Holland; George Jaworski, Bala Cynwyd, both of Pa.

[73] Assignee: Murata Wiedemann, Inc., King of Prussia, Pa.

[21] Appl. No.: 351,343

[22] Filed: May 15, 1989

[51] Int. Cl.[5] ..... B26F 1/14

[52] U.S. Cl. ..... 83/139; 83/140

[58] Field of Search ..... 83/134, 138, 139-140, 83/684, 686, 689, 552, 549

[56] References Cited

U.S. PATENT DOCUMENTS

| | | | |
|---|---|---|---|
| 3,160,046 | 8/1962 | Bredow | 83/130 |
| 3,540,339 | 11/1970 | Killaly | 83/552 X |
| 4,166,403 | 9/1979 | DiDonato, Jr. et al. | 83/139 X |
| 4,428,262 | 1/1984 | Vlahek | 83/139 |
| 4,516,449 | 5/1985 | Boyette | 83/136 X |
| 4,532,845 | 8/1985 | Jinnouchi | 83/552 |

*Primary Examiner*—Hien H. Phan
*Assistant Examiner*—Ken Peterson
*Attorney, Agent, or Firm*—John R. Benefiel; Raymond J. Eifler

[57] ABSTRACT

A punch holder (10) including a punch holder member (20) with a stripper arrangement including a sleeve (36) axially movable with repsect to the holder member (20) each of the holder members (20) and sleeve (36) fit end to end within a bore (79) in an outer member (78), and stripper spring (38) interposed between the holder member (20) and sleeve (56) combined with a resilient cup piece (58) fit to the end of the sleeve (36) enclosing the lower end face (56) of the sleeve (36).

10 Claims, 1 Drawing Sheet

PUNCH HOLDER WITH A STRIPPER ARRANGEMENT

This invention concerns punch holders and more particularly arrangements included in such holders for stripping the punch from the workpiece after penetration by the punch. There is often a tendency for a punch to be tightly gripped by the workpiece after penetration so that withdrawal requires that the workpiece be held down while the press ram is elevated to extract the punch.

The usual arrangement for accomplishing such hold down, includes a stripper plate and interposed stripper springs, the stripper plate forced into engagement by the downward stroking of the ram compressing the stripper springs. As the ram is elevated, the workpiece is held down by the stripper springs long enough so that the punch is freed from the workpiece. With continued ram elevation, the stripper plate is lifted clear of the workpiece.

There has heretofore been provided punch holders in which the stripper arrangement is built in so that the punch press structure itself need not include an ancillary structure for this purpose. In this arrangement, a stripper spring surrounds the punch and acts on a sleeve which in turn has a stripper plate secured to the lower end. The stripper plate has an opening closely fit to the punch shape through which the punch passes when the punch is driven by the punch ram. The stripper plate in these designs is conventionally constructed of steel, and the force of the stripper springs may cause marring of soft metal workpieces, such as those constructed of aluminum.

Further, the use of machined stripper plates is relatively costly, as each must be custom fit to an individual punch shape. A close fitting of the opening to the punch is required to avoid cratering of the edges of the workpiece adjacent the punched hole, and requires assembly of a stripper plate custom fit to each individual punch.

Another approach has been to provide a punch holder with an end cap of a elastically compressible material such as urethane plastic. The end cap is forced against the workpiece surface and compressed by the ram as the punch is driven into the workpiece. The end cap holds the workpiece down as the punch is withdrawn until the compression thereof is relieved. This thus provides the stripping function by a simple element included within the punch holder itself, and eliminates the workpiece marring problem of the steel stripper plates. Further, the punch opening can be formed by stroking the punch with a blank end cap in place, so that the cost of manufacture is minimal and a common blank can be used for a number of punches.

However, the extent of compression and the stripping forces able to be generated is more limited than the above described arrangement of stripper springs, and this approach cannot be used for thick workpieces or difficult to punch materials such as stainless steel. Use of stiffer materials results in a tendency for early failure by splitting of the end cap.

SUMMARY OF THE INVENTION

The present invention is a stripping arrangement self contained within a punch holder, comprised of a sleeve surrounding the punch coupled to the press ram. The sleeve is axially movable relative to the punch and extends to locate an end face adjacent the leading end of the punch. A stripper spring is inter posed acting on the upper end of the sleeve and the punch holding structure. An elastic end cap is fit over the lower end face of the sleeve so as to engage the workpiece surface as the punch ram is stroked. Both the stripper spring and the elastic end cap are compressed as the ram is stroked so that a composite stripping force is generated composed of the compressed stripper spring and elastic end cap. The elastic end cap has a punch opening formed by stroking of the punch itself to penetrate an end cap blank during the initial punching operation.

This arrangement has the advantage of affording the capability of creating a high level of stored energy in the stripper springs while using an elastic, non-marring end cap interposed as a stripper plate, but which is not unduly stressed by compression to insure long life while generating high levels of stripping force.

End cap blanks may be provided usable with any punch and which have openings shaped by the punch itself to offer the advantage of being provided at very low cost.

The arrangement has the further advantages of simplifying and allowing quick changeover of punches and strippers, as well as the use of standard punch configurations.

DESCRIPTION OF THE DRAWINGS

FIG. 1 illustrates a punch holder 10 of the rotary indexing type, adapted to accommodate a multitool selection capability. Such multitool punch holders are described in copending U.S. patent applications Ser. No. 07/355,237 filed on May 22, 1989, now U.S. Pat. No. 4,929,276, and Ser. No. 07/355,252 filed on May 22, 1989. The punch holder 10 herein described is configured with the same envelop, but housing only a single punch 12 of standard configuration. The punch 12 includes a shank 14 having a keyway 16 mating with a key 18 fixed to a punch holder member 20.

Figure 1:
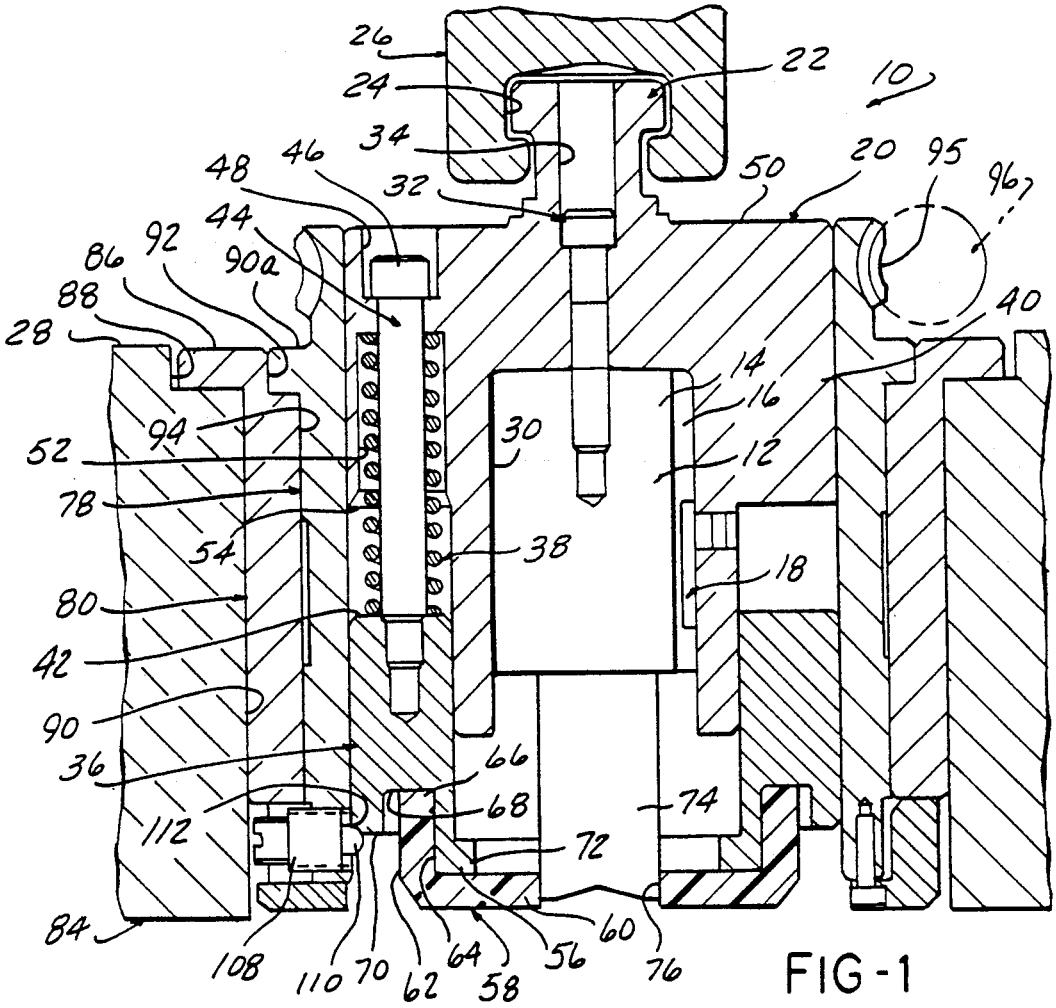
FIG. 1 is a longitudinal sectional view of a punch holder incorporating a stripping arrangement according to the present invention.

The punch holder member 20 comprises a cylindrical member having a tee head portion 22 adapted to be mated with a tee slot 24 formed into a punch ram 26.

The punch holder member 20 is formed with a cavity 30 slidably fit to the shank 14 of the punch 12, with a capscrew 32 received in counterbore opening 34 extending axially into the upper end of the tee head portion 22 threadably received in the shank 14 to secure the punch 12 therein.

The punch holder 10 further includes a sleeve 36 slidably fit over the lower end of the holder member 20 to extend below the lower end thereof. A quantity of stripper springs 38 are interposed between a radial flange portion 40 of the holder member 20 and the upper end face 42 of the sleeve 36. The stripper spring 38 in this case are installed over guide bolts 44 threaded into the upper end face 42 of the sleeve 36.

The head 46 of the guide bolt 44 is seated on a counterbore 48 extending into the upper end face 50 of the holder member 20. The stripper spring 38 is nested into a counterbore 52 recessed into the lower face 54 of the holder member 20.

The lower end face 56 of the sleeve 36 is enclosed with a cup piece 58 of a plastic material such as a hard urethane. The cup piece 58 has a face portion 60 extending across end face 56 of the sleeve 36 and a skirt portion 62 surrounding the adjacent side 64 of the sleeve 36. The skirt portion terminates in one or more antirotation tabs 66 received in pockets 68 relieved into a stepped shoulder 70 formed on the sleeve 36.

The end face 56 is comprised of a radial face having an opening 72 large enough to accommodate the full range of punch sizes to be employed in the punch holder 10. The leading end 74 of the punch 12 extends through an opening 76 tightly fit to the punch leading end 74 by virtue of being formed by the punch itself, as will be described herein.

The holder member 20 and sleeve 36 are positioned in end-to-end alignment within a bore 79 in an indexing sleeve 78 to be axially slidable therein, and conceativieity thereby maintained nested within a bushing 80 seated in a bore 90 formed in the upper turret plate 84 of a punch press. The bushing 80 has a flange 86 received in a counterbore 88 portion of a bore 90 machined in the turret 84 to be axially and radially located therein. The index sleeve 78 is likewise formed with a flange 90A seated in a counterbore portion 92 of a bore 94.

The index sleeve 78 is formed with a worm gear 95 driven by a worm 96 for purposes of selecting one of a multitool for multitool holders as described in the aforementioned U.S. patent applications, or to reorient the punch 12.

Figure 2:
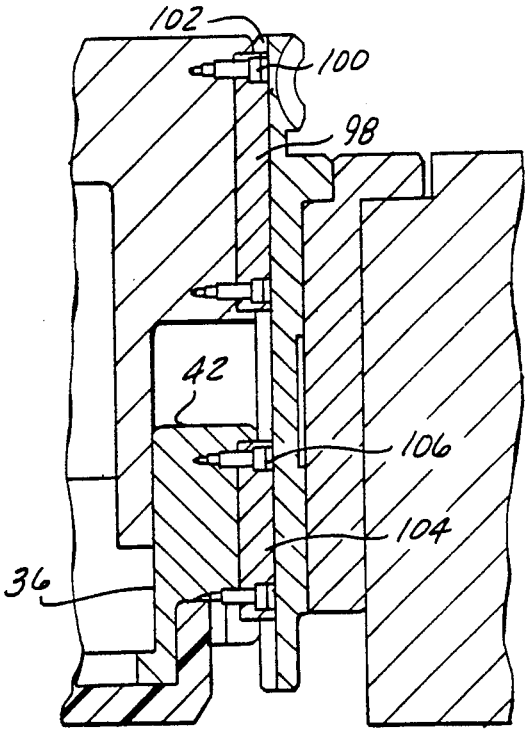
FIG. 2 is a fragmentary enlarged sectional view of portions of the punch holder shown in FIG. 1.

FIG. 2 shows that the assembly of the index sleeve 78, sleeve 36, and holder member 20 are rotationally locked together. A key 98 is fastened with screws 100 to the holder member 20, key 98 fit within keyway slot 102 formed in index sleeve 78 to establish said rotational lock while accommodating relative axial movement of the holder member 20.

Sleeve 36 likewise has a key 104 attached thereto with screws 106, key 104 also fit in keyway slot 102 for the same purpose.

FIG. 1 shows that the holder member 20 and sleeve 36 are releasably retained axially within the index sleeve 78 by a peripheral series of spring plunger detents 108 including a plunger 110 engaging a lip 112 on the sleeve 36. The stroking of the ram 26 overcomes the retainer force when the punching operation takes place.

Figure 3:
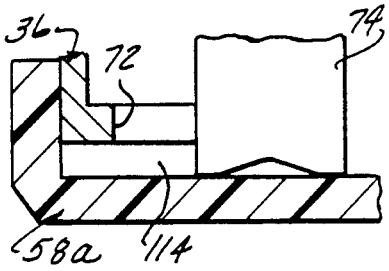
FIG. 3 is a fragmentary sectional view of an end cap blank partially assembled onto the punch holder preparatory to the initial forming step.

FIG. 3 shows that the cup piece 58 is provided in blank form **58*a* without any opening 76 formed in face 60. The cup piece blank 58*a* is initially assembled over the sleeve 36 with a gap 114 therebetween and the punch portion 74** positioned above.

Figure 4:
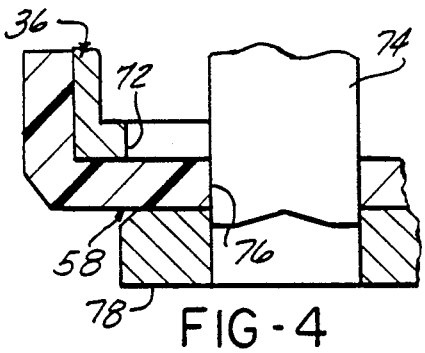
FIG. 4 is a fragmentary sectional view of an end cap fully seated on the punch holder after the initial forming step is completed. Detailed Description

FIG. 4 shows that when the press is cycled with a die 77 but without a workpiece, the punch portion 74 will penetrate the face 60 to form the opening 76, and the cup piece 58 will be fully seated on the sleeve 36.

In operation, the ram 26 is stroked downwardly bringing the cup piece 58 against the upper surface of a workpiece. Continuing descent of the ram 26 compresses the cup piece 58 as well as the stripper spring 38 and the punch 12 is advanced through the opening 76 and into the workpiece and die 77.

The ram 26 is elevated after the completion of its downstroke, raising the punch 12. The cup piece 58 remains in position against the workpiece held by the composite force of the compression of the cup piece 58 and the stripper spring 38, enabling withdrawal of the punch portion 74 from the workpiece.

After the ram 26 is elevated sufficiently to relieve the compression of the cup piece 58 and stripper spring 38, and engagement of the head 46 of bolt 44, the sleeve 36 is raised to free the workpiece.

We claim:

1. A punch holder (10) for holding a punch (12) having a shank (14), and a punch portion (74) protruding therefrom, said punch holder (10) having a stripper arrangement and including a holder member (20) having a cavity (30) receiving the shank (14) of the punch (12) fixed therein, said holder member (20) including a head (22) for engagement with a punch press ram (26), characterized by an outer sleeve (78) having a bore (79), a sleeve (36) disposed beneath said holder member (20) and coaxially aligned therewith, both said holder member (20) and said sleeve (36) axially movable in said bore (79) to maintain concentricity therebetween, a stripper spring (38) interposed between said holder member (20) and said sleeve (36) urging said holder member (20) and sleeve (36) to an axially spaced apart condition, a cup piece (58) of a soft resilient material covering the lower end (56) of said sleeve (36), said lower end (56) of said sleeve (36) receiving said protruding punch portion (14), the lower end covered by said cup piece (58).

2. The punch holder (10) according to claim 1 wherein said cup piece (58) is constructed of urethane plastic.

3. The punch holder (10) according to claim 1 wherein said sleeve (36) is slidably mounted on a lower end portion of said holder member (20) said sleeve (36) and said holder member (20) having spaced apart opposing radial face surfaces (42, 54).

4. The punch holder (10) according to claim 3 further including a bolt member (44) extending into each of said opposing radial face surfaces (42, 54) with said stripper spring (38) encircling said bolt.

5. The punch holder (10) according to claim 1 wherein said sleeve (36) includes a radial surface (70) having pockets (68) formed therein, said cup piece (58) having skirt portions, said skirt portions (62) extending into said pockets (68).

6. The punch holder (10) according to claim 1 wherein further including means (78, 98, 104, 102) rotationally locking said holder member (20) and said sleeve (36) together while allowing relative axial movement therebetween to compress said stripper spring (38).

7. The punch holder (10) according to claim 6 wherein said outer sleeve (78) comprises a rotary index sleeve (78) having said bore (79) formed therein which slidably receives said holder member (20) and said sleeve (36) and maintaining concentricity therebetween.

8. The punch holder (10) according to claim 1 wherein said cup piece (58) includes an end face completely extending across and below said punch (12) to be punched through upon an initial ram punching cycle operation without a workpiece.

9. The punch holder (10) according to claim 7 further including multiple spring plunger detent means (108) yieldably retaining said holder member (20) and sleeve (36) against axial movement out of said index sleeve (78).

10. The punch holder (10) according to claim 3 further including an end face (56) spaced radially inward from said radially opposing surface (42) and enclosed within said cup piece (58).

* * * * *